US010487815B2

(12) United States Patent
Chou

(10) Patent No.: US 10,487,815 B2
(45) Date of Patent: Nov. 26, 2019

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 261 days.

(21) Appl. No.: 15/402,510

(22) Filed: Jan. 10, 2017

(65) Prior Publication Data

US 2017/0204843 A1 Jul. 20, 2017

(30) Foreign Application Priority Data

Jan. 15, 2016 (TW) ..... 105101307 A

(51) Int. Cl.

| | |
|---|---|
| ***F04B 39/10*** | (2006.01) |
| ***F04B 35/04*** | (2006.01) |
| ***F04B 39/12*** | (2006.01) |
| ***F04B 39/00*** | (2006.01) |
| ***F04B 41/02*** | (2006.01) |

(52) U.S. Cl.

CPC ..... *F04B 39/10* (2013.01); *F04B 35/04* (2013.01); *F04B 39/0027* (2013.01); *F04B 39/121* (2013.01); *F04B 39/122* (2013.01); *F04B 39/123* (2013.01); *F04B 39/125* (2013.01); *F04B 41/02* (2013.01); *F05C 2225/00* (2013.01)

(58) Field of Classification Search

CPC ..... F04B 39/10; F04B 41/02; F04B 39/0027; F04B 39/125; F04B 39/123; F04B 39/122; F04B 39/121; F04B 35/04; F05C 2225/00

See application file for complete search history.

(56) References Cited

U.S. PATENT DOCUMENTS

| | | | | |
|---|---|---|---|---|
| 3,179,055 | A * | 4/1965 | Kalert, Jr. | F02M 1/00 210/416.4 |
| 3,898,793 | A * | 8/1975 | Nakamura | F01D 25/162 184/6.11 |
| 4,471,812 | A * | 9/1984 | Bertsch | F16K 17/0453 137/527.6 |
| 4,542,768 | A * | 9/1985 | Harris | F16K 17/0413 137/513.5 |
| 5,647,395 | A * | 7/1997 | Hashimoto | F04B 39/1073 137/514 |
| 2005/0274036 | A1* | 12/2005 | Osvatic | A47L 15/488 34/201 |
| 2008/0080986 | A1* | 4/2008 | Hinrichs | F04B 27/1063 417/222.1 |
| 2009/0028733 | A1* | 1/2009 | Duwel | F04B 39/1066 417/546 |
| 2009/0110721 | A1* | 4/2009 | McAllister | A61J 3/071 424/451 |

(Continued)

*Primary Examiner* — Peter J Bertheaud
*Assistant Examiner* — Dnyanesh G Kasture

(57) ABSTRACT

An improved air compressor includes a cylinder that is fitted with a piston body and defines at its top wall a plurality of exit holes which are approximately equal in diameter and can be regulated by a resilient sheet having a plurality of branches to enable the cylinder to communicate with an air storage container. The exit holes are normally sealed by the branches of the resilient sheet with the assistance of compression springs when the air compressor is not in operation. The exit holes allow the compressed air produced in the cylinder to quickly enter the air storage container, so that the piston body can conduct reciprocating motion more smoothly and thus the performance of the air compressor can be increased.

4 Claims, 9 Drawing Sheets

(56) References Cited

U.S. PATENT DOCUMENTS

2016/0149280 A1* 5/2016 Lorenzo ..... H01P 1/062
343/756
2017/0218949 A1* 8/2017 Yokoi ..... F04B 45/047

* cited by examiner

AIR COMPRESSOR

TECHNICAL FIELD OF THE INVENTION

The present invention relates to an air compressor and, more particularly, to an improved air compressor which includes a cylinder being fitted with a piston body and defining a plurality of exit holes of approximately equal dimension, so that compressed air produced in the cylinder may quickly enter an air storage container, so that the piston body can conduct reciprocating motion more smoothly and thus the performance of the air compressor can be increased.

DESCRIPTION OF THE PRIOR ART

Currently, an air compressor basically has a cylinder which allows a piston body to conduct reciprocating motion therein to produce compressed air which can overcome a valve mechanism, so that the compressed air can flow through an exit hole of the cylinder to enter the inner space of an air storage container or an air tank. The air storage container is provided with outlets for delivering the compressed air to an object to be inflated.

In conventional air compressors, there is only one exit hole defined at the cylinder for communicating with the air storage container. The exit hole of the cylinder is controlled by a valve mechanism, which generally includes a plug and a compression spring, so that the exit hole can be opened or closed properly according to the pressure of the compressed air. In operation, the compressed air produced in the cylinder can overcome the compressive force of the compression spring to enter the inner space of the air compressor. However, the compressed air stored in the air storage container can exert a back force on the plug, thus restraining the plug being moved away from the exit hole. As a result, the piston body, which conducts reciprocating motion in the cylinder, will be subjected to greater resistance. Therefore, the piston body may not move smoothly in the cylinder, and thus the speed of inflating an object will become slow. Furthermore, the motor of the air compressor may become too hot, thus decreasing the performance of the motor. Even worse, the motor may be under the risk of burning out.

In view of the foregoing, the applicant intends to develop an improved air compressor which can solve the shortcomings of conventional air compressors.

SUMMARY OF THE INVENTION

One object of the present invention is to provide an improved air compressor, wherein a cylinder thereof defines a plurality of exit holes, through which a large amount of compressed air produced in the cylinder may enter an air storage container in a short time.

Another object of the present invention is to provide an improved air compressor, wherein a cylinder thereof is fitted with a piston body and defines a plurality of exit holes of approximately equal dimension, so that a large amount of compressed air produced in the cylinder may enter an air storage container in a short time. Since the compressed air can quickly enter the air storage container, the piston body can conduct reciprocating motion more smoothly and thus the performance of the air compressor and the speed of inflating an object can be increased.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
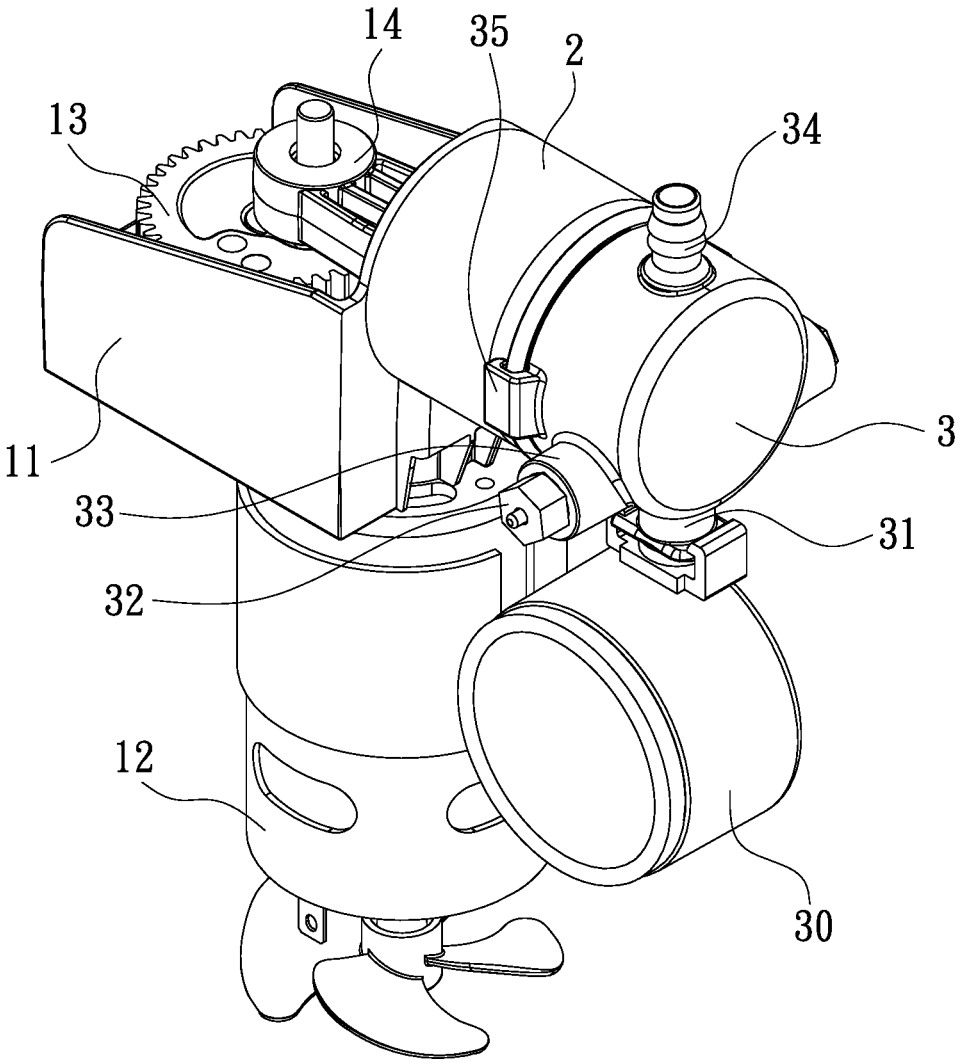
FIG. 1 shows a 3-dimensional view of an air compressor according to one embodiment of the present invention.
Figure 2:
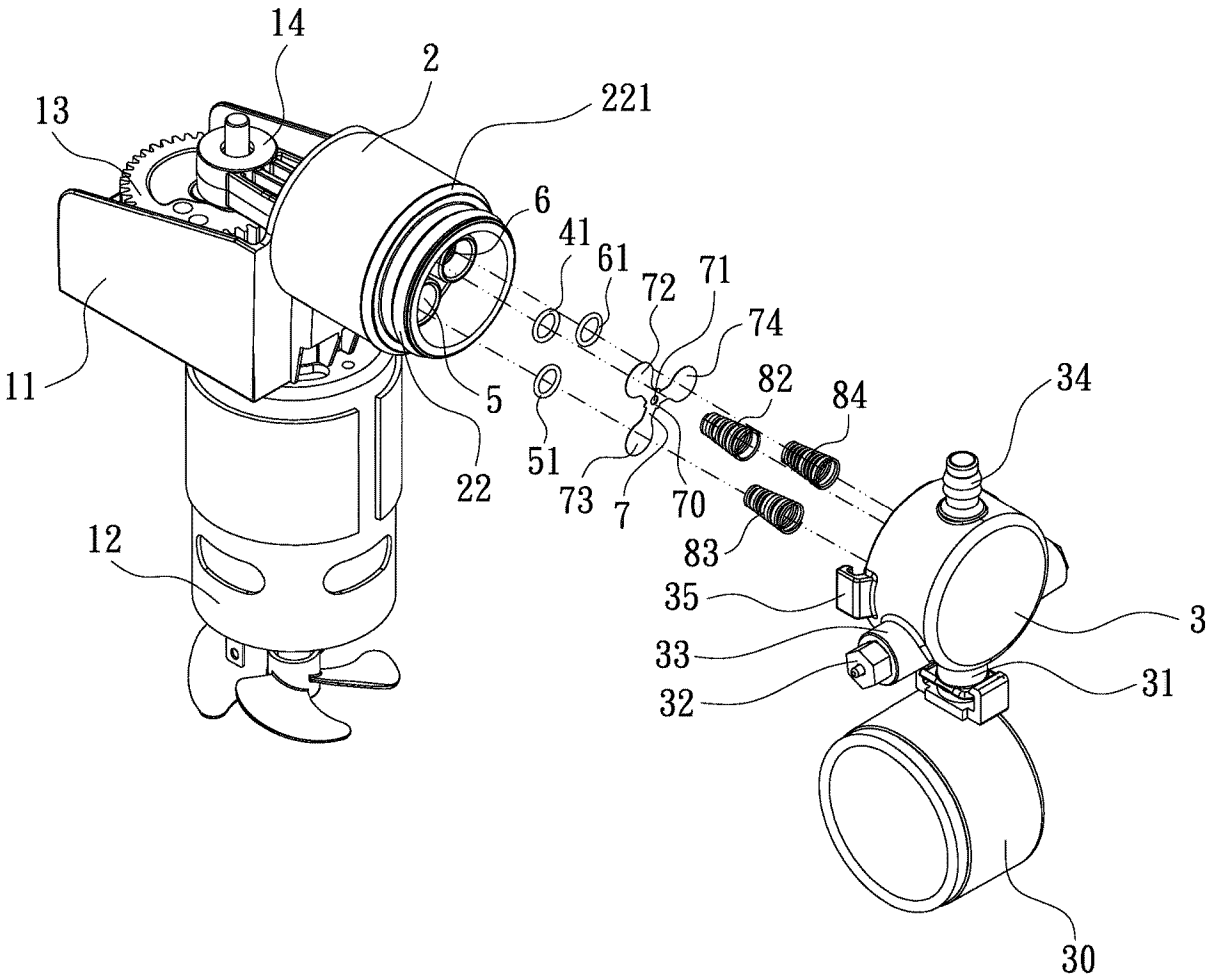
FIG. 2 shows an exploded view of the air compressor.

Referring to FIGS. 1 and 2, an air compressor according to one embodiment of the present invention is shown, which generally comprises a cylinder 2 fitted with a piston body 14, and a main frame 11 for mounting a motor 12 which can rotate a gear 13 to drive the piston body 14 to conduct reciprocating motion for producing compressed air in the cylinder, which may enter an air storage container 3 provided with one or more outlets for supplying air to various devices. For example, the outlet 31 can be used for connecting with a pressure gauge 30, the outlet 33 can be used for connecting with a relief valve 32, and the outlet 34 can be connected with a hose for inflating an object (not shown).

Figure 3:
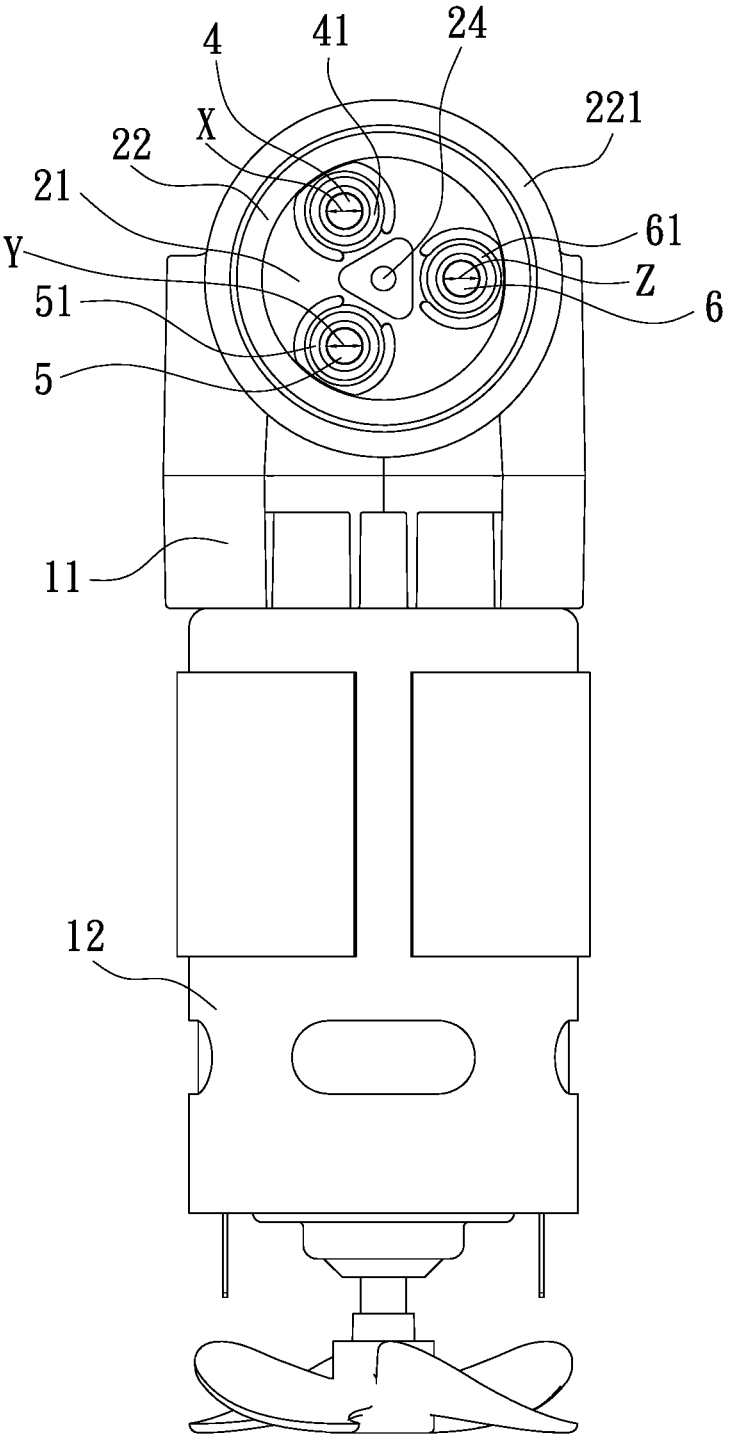
FIG. 3 shows a plan view of the air compressor, wherein a plurality of exit holes defined at a cylinder thereof are revealed.
Figure 4:
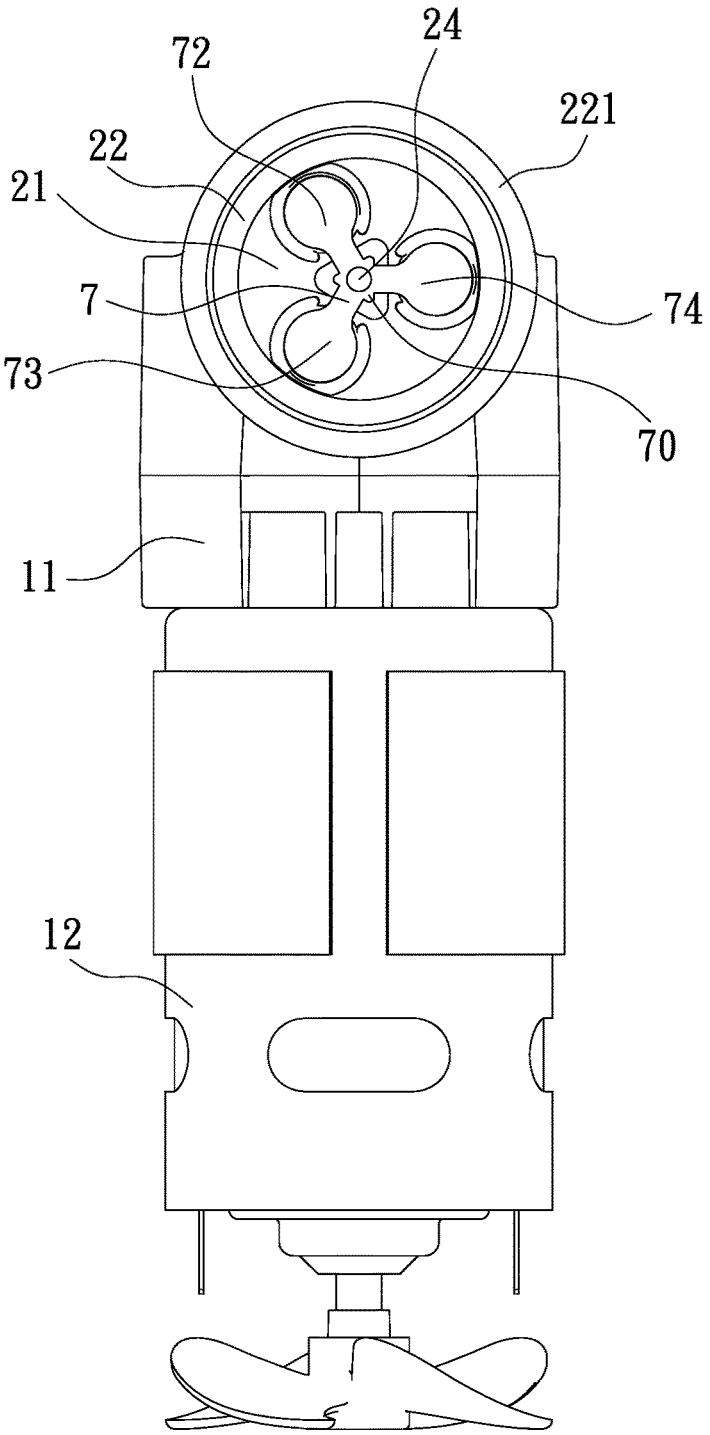
FIG. 4 shows a plan view of the air compressor, wherein a resilient sheet being used to seal the exit holes is revealed.
Figure 5:
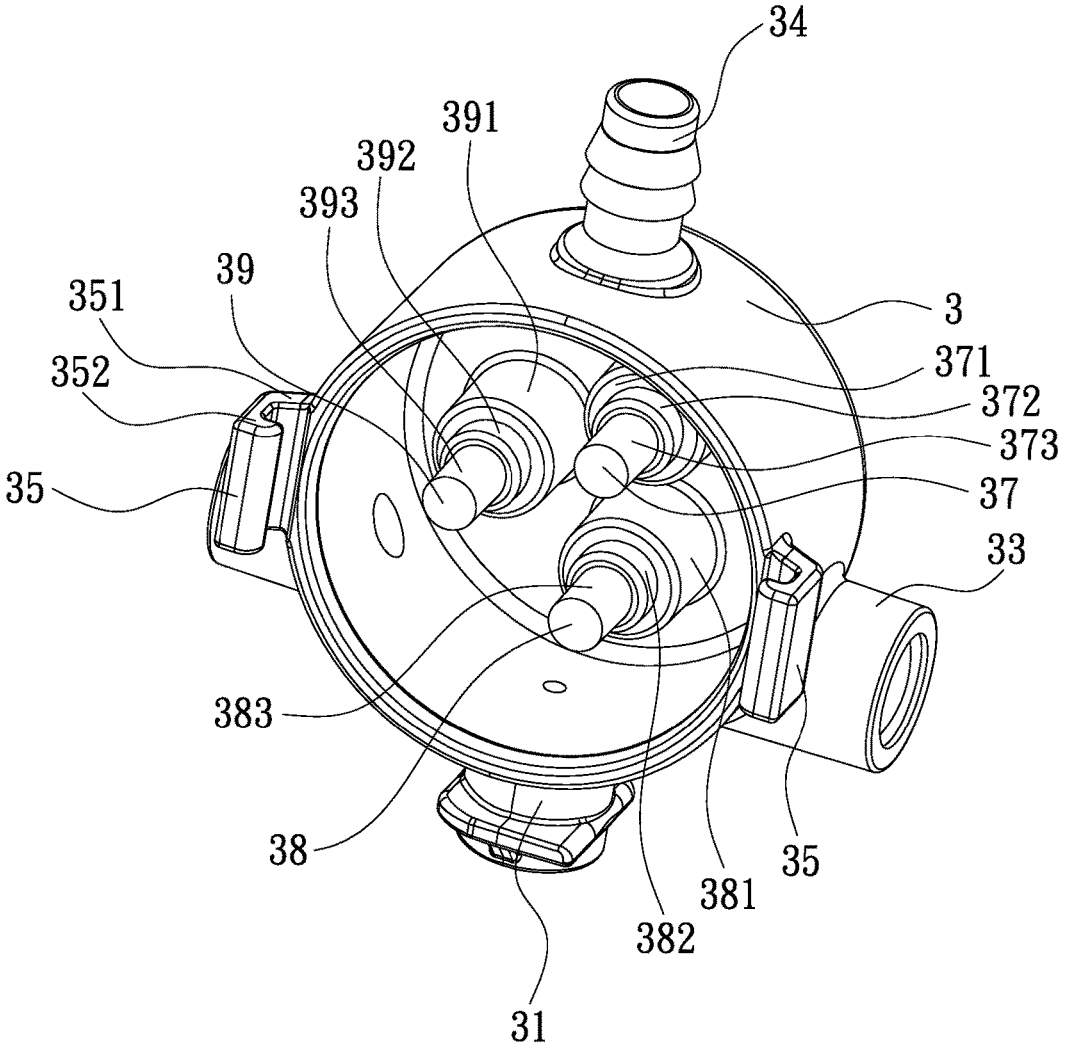
FIG. 5 shows a 3-dimensional view of an air storage container used in the air compressor, wherein a plurality of columns provided at an inner surface of the air storage container are revealed.
Figure 6:
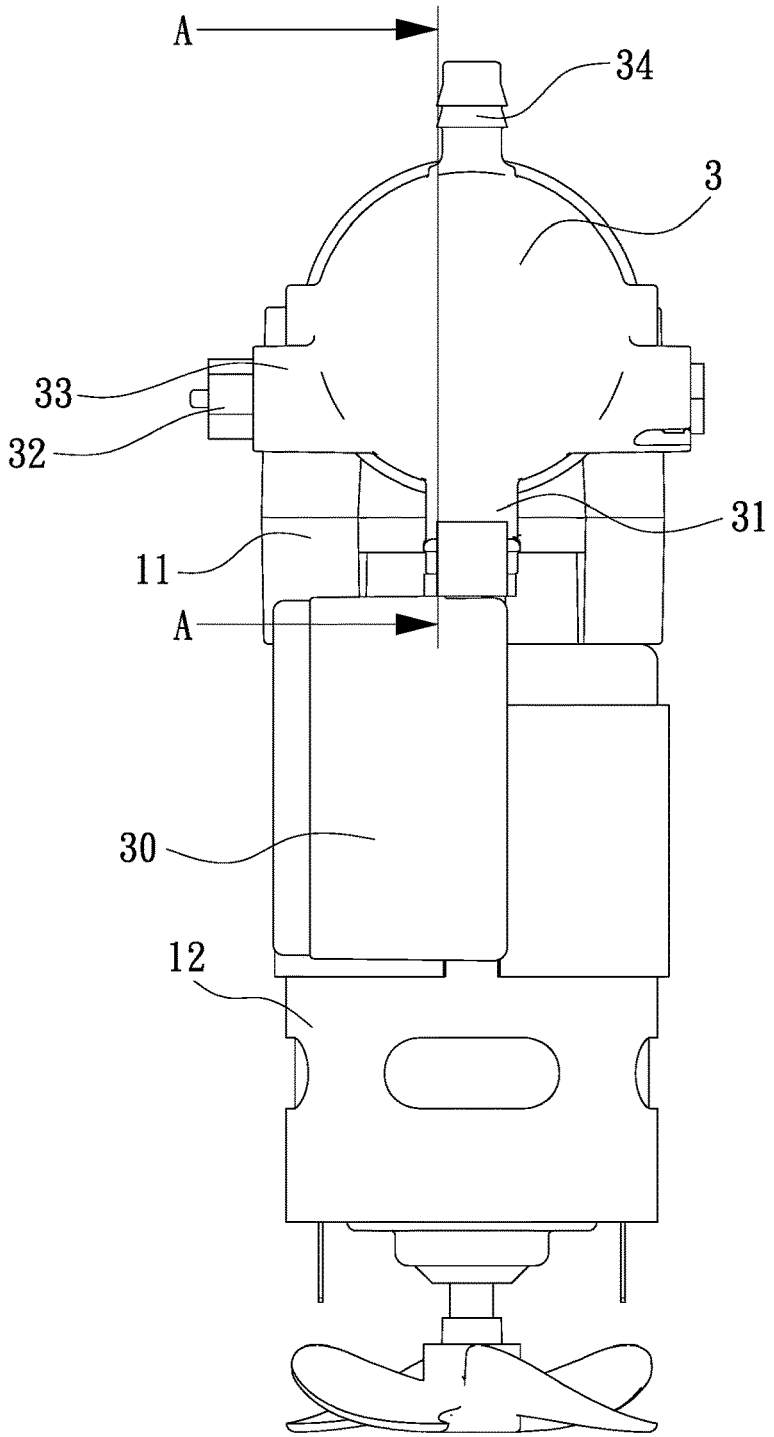
FIG. 6 shows a plan view of the air compressor, wherein the air storage container is assembled onto the cylinder.
Figure 7:
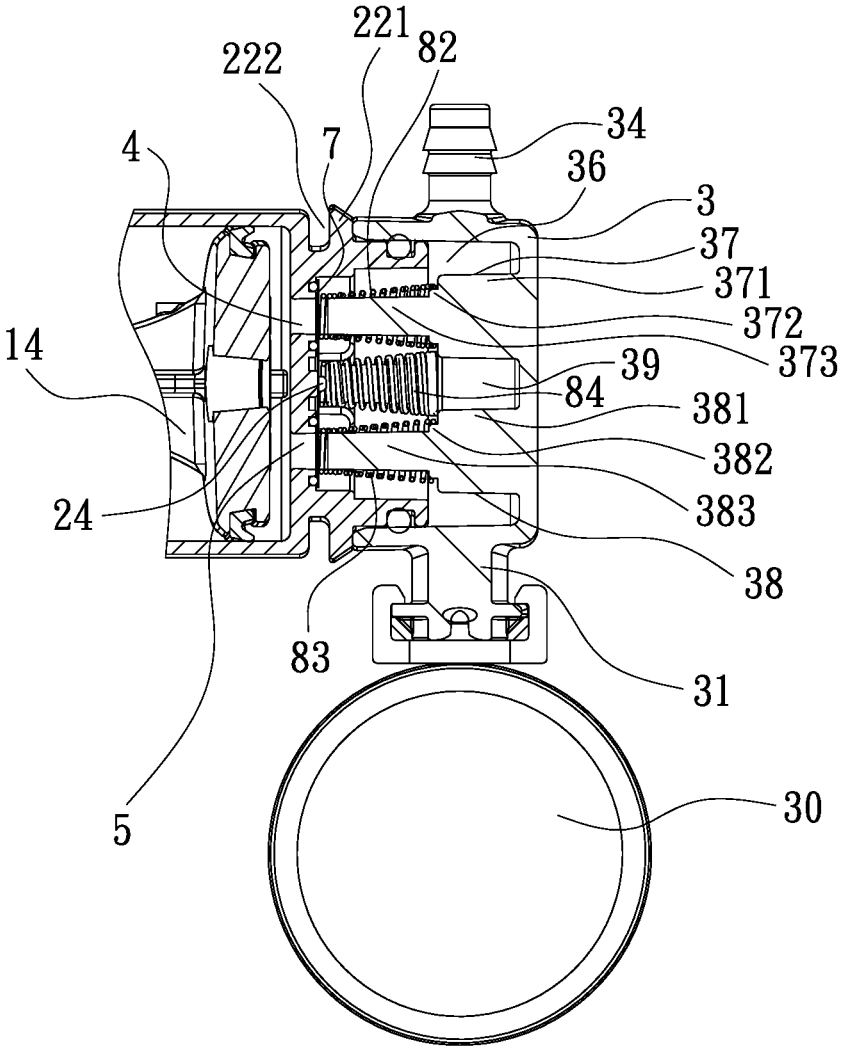
FIG. 7 shows a sectional view of the air compressor taken along line A-A in FIG. 6.

Referring to FIGS. 2 through 7, the air compressor is designed in a way different from conventional technology. The cylinder 2, which defines three exit holes 4, 5, 6 at its top wall 21, can be formed integrally with the main frame 11 by plastic material. The exit holes 4, 5, 6 are approximately equal in dimension. As shown in FIG. 3, the exit hole 4 is defined to have a diameter of (X), the exit hole 5 is defined to have a diameter of (Y), and the exit hole 6 is defined to have a diameter of (Z), wherein X=Y=Z; namely, the exit holes 4, 5, 6 have the same diameter. The exit holes 4, 5, 6 are regulated by a control mechanism to be opened or closed. The control mechanism includes a plurality of O-rings 41, 51, 61, a resilient sheet 7, and a plurality of compression springs 82, 83, 84. The O-ring 41 can be placed around the exit hole 4. The O-ring 51 can be placed around the exit hole 5. The O-ring 61 can be placed around the exit hole 6. The resilient sheet 7 has a root 70 and a plurality of branches 72, 73, 74 extending from the root 7 and corresponding to the exit holes 4, 5, 6. The root 70 of the resilient sheet 7 defines a positioning hole 71 and is attached to the top wall 21 by fitting the positioning hole 71 over a boss 24 provided on the top wall 21. The compression spring 82 can urge the branch 72 of the resilient sheet 7 against the O-ring 41 to seal the exit hole 4 (see FIGS. 2, 4 and 7). The compression spring 83 can urge the branch 73 of the resilient sheet 7 against the O-ring 51 to seal the exit hole 5. The compression spring 84 can urge the branch 74 of the resilient sheet 7 against the O-ring 61 to seal the exit hole 6. The cylinder 2 has a tubular projection 22 formed on the top wall 21. The tubular projection 22 is provided with a circular flange 221 at its outer surface and defines an annular groove 222 between the circular flange 221 and the top wall 21. The air storage container 3 is provided with two opposite coupling means 35 (see FIG. 5), each of which includes a base portion 351 extending outwardly from a bottom edge of the air storage container 3, and an L-shaped holding portion 352 integrally formed at one end of the base portion 351 distal from the bottom edge of the air storage container 3. Furthermore, the air storage container 3 is provided at an inner surface thereof with a plurality of columns 37, 38, 39 corresponding to the compression springs 82, 83, 84. The column 37 has a base round portion 371, a middle round portion 372, and an end round portion 373; the column 38 has a base round portion 381, a middle round portion 382, and an end round portion 383; the column 39 has a base round portion 391, a middle round portion 392, and an end round portion 393; wherein the diameter of the base round portion 371, 381 or 391 is greater than that of the corresponding middle round portion 372, 382 or 392, and the diameter of the middle round portion 372, 382 or 392 is greater than that of the corresponding end round portion 373, 383 or 393. The L-shaped holding portions 352 of the coupling manse 35 of the air storage container 3 can be inserted into the annular groove 222 and engaged with the circular flange 221, so that the air storage container 3 can be detachably assembled onto the cylinder 2. As shown in FIG. 7, each of the compression springs 82, 83, 84 has one end forcing against the corresponding branch 72, 73 or 74 of the resilient sheet 7 and has another end being fitted around the middle round portion 372, 382 or 392 of the corresponding column and forcing against the base round portion 371, 381 or 391 of the corresponding column. Each of the end round portions 373, 383, 393 of the columns 37, 38, 39 is located at a predetermined height above the corresponding branch of the resilient sheet 7 so as to limit the movement of the corresponding branch, so that the resilient sheet 7 can be prevented from elastic fatigue.

Figure 8:
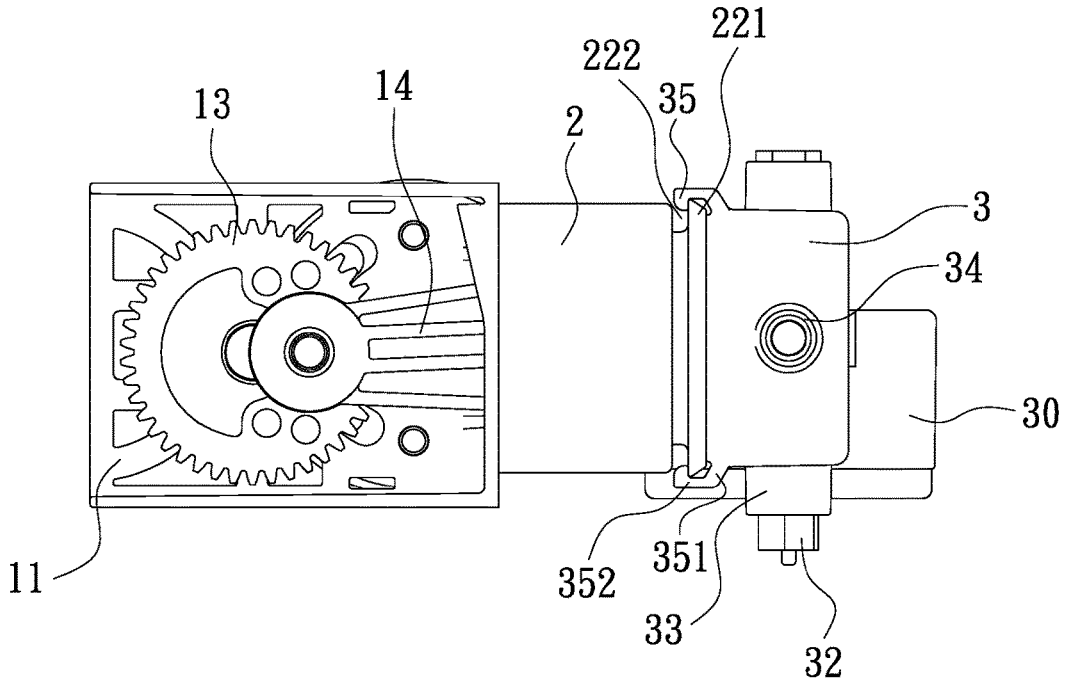
FIG. 8 shows a plan view of the air compressor, wherein a gear and a piston body used in the air compressor are revealed.

Referring to FIGS. 7 and 8, when the piston body 14 conducts reciprocating motion, the compressed air produced in the cylinder 2 can overcome the force of the compression springs 82, 83, 84 exerted on the branches 72, 73, 74 of the resilient sheet 7, thus pushing the branches 72, 73, 74 of the resilient sheet 7 away from the exit holes 4, 5, 6, respectively, so that the compressed air can flow into the inner space 36 of the air storage container 3. Initially, since the compressed air can flow into the inner space 36 of the air storage container 3 simultaneously via the exit holes 4, 5, 6, the air storage container 3 can be filled with a large amount of air in a short time. Later, since there is a large amount of air having entered the inner space 36 of the air storage container 3, the air contained in the air storage container 3 can exert a greater back force on the branches 72, 73, 74 of the resilient sheet 7 compared to the air initially contained in the air storage container 3. In other words, the piston body 14 may experience greater resistance in conducting reciprocating motion, and thus may cause the exit holes 4, 5, 6 more difficult to be opened. However, upon a decrease of the pressure of the air contained in the air storage container 3, the back force exerted on the branches 72, 73, 74 of the resilient sheet 7 will decrease and this allows the compressed air produced in the cylinder 2 to quickly enter the inner space 36 of the air storage container 3. Considering the operation of the air compressor as a whole, since the multiple exit holes allow the piston body 14 to conduct reciprocating motion more smoothly, the performance of the air compressor can be increased. Thus, the air compressor can inflate an object more quickly.

Figure 9:
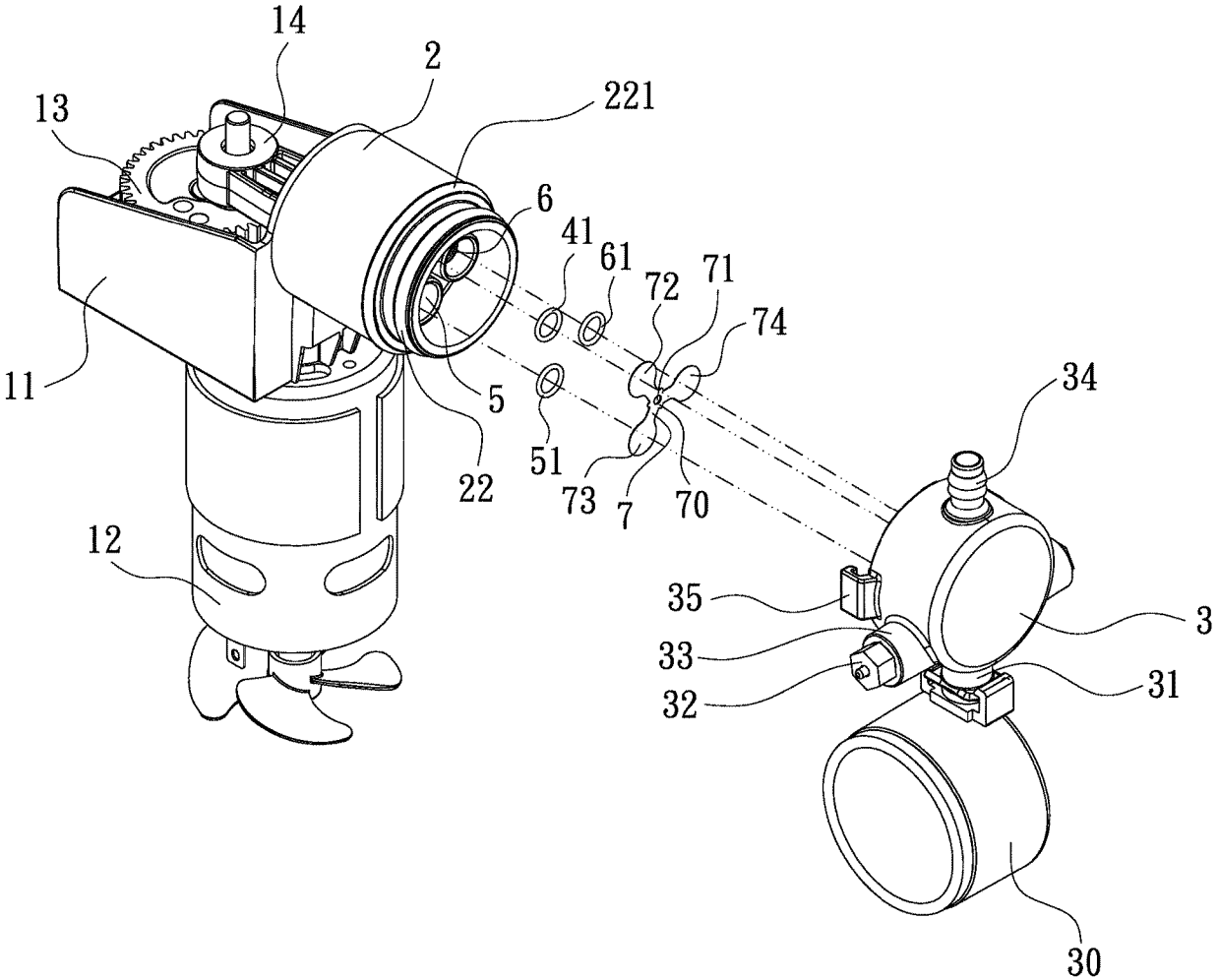
FIG. 9 shows an exploded view of an air compressor according to another embodiment of the present invention.

In this embodiment, as shown in FIG. 2, the branches 72, 73, 74 of the resilient sheet 7 are respectively subjected to the compressive forces of the compression springs 82, 83, 84, so that the branches 72, 73, 74 can seal the exit holes 4, 5, 6 more quickly. Nevertheless, in another embodiment, as shown in FIG. 9, the compression springs 82, 83, 84 can be dispensed with; namely, the branches 72, 73, 74 can provide compressive forces by themselves without additional springs to be in tight contact with the O-rings 41, 51, 61, thus sealing the exit holes 4, 5, 6.

As a summary, the air compressor of the present invention has a breakthrough over the prior art in that the top wall 21 of the cylinder 2 defines a plurality of exit holes 4, 5, 6, which are approximately equal in dimension and controlled by the branches 72, 73, 74 of the resilient sheet 7 to allow the compressed air produced in the cylinder 2 to quickly enter the inner space 36 of the air storage container 3, so that the piston body 14 can conduct reciprocating motion more smoothly and thus the performance of the air compressor can be increased. These features render the air compressor of the present invention useful and inventive.

What is claimed is:

1. An air compressor including a main frame for mounting a motor configured to rotate a gear to drive a piston body disposed in a cylinder to perform reciprocating motion for producing compressed air that enters an inner space of an air storage container, wherein:

the cylinder comprises a top wall, the top wall comprising a plurality of exit holes;

flow from the exit holes is regulated by a control mechanism, the control mechanism including a plurality of O-rings each respectively corresponding to one of the exit holes, a resilient sheet having a root and a plurality of branches extending from the root, each of the branches respectively corresponding to one of the exit holes, and a plurality of compression springs each respectively corresponding to one of the branches of the resilient sheet, the O-rings being respectively placed around the exit holes, the root of the resilient sheet being attached to the top wall, the compression springs urging the branches of the resilient sheet against the O-rings to respectively seal the exit holes;

the air storage container comprises a plurality of coupling means disposed at a bottom edge of the air storage container, each coupling means including a base portion extending outwardly from the bottom edge of the air storage container, and an L-shaped holding portion integrally formed at one end of the base portion distal from the bottom edge of the air storage container;

the cylinder has a tubular projection coupled to the top wall, an outer surface of the tubular projection comprising a circular flange, and an annular groove between the circular flange and the top wall for accepting the L-shaped holding portions of the air storage container for insertion into the annular groove and engaging the circular flange;

an inner surface of the air storage container comprises a plurality of columns, each column corresponding to one of the branches of the resilient sheet, each of the columns having a base round portion, a middle round portion, and an end round portion; and each of the compression springs has one end abutting a corresponding branch of the resilient sheet, and has another end disposed around the middle round portion of a corresponding column and abutting the base round portion of the corresponding column, wherein each of the end round portions of the columns is located at a predetermined distance from the corresponding branch of the resilient sheet to limit movement of the corresponding branch.

2. The air compressor of claim 1, wherein the cylinder is formed integrally with the main frame from a plastic material.

3. The air compressor of claim 1, wherein the exit holes have equal-diameters.

4. The air compressor of claim 1, wherein the root of the resilient sheet comprises a positioning hole, the root being attached to the top wall by fitting the positioning hole over a boss provided on the top wall.

* * * * *